US007980652B2

(12) United States Patent
Baba et al.

(10) Patent No.: US 7,980,652 B2
(45) Date of Patent: Jul. 19, 2011

(54) PRINTING APPARATUS AND CALIBRATION METHOD

(75) Inventors: Naoko Baba, Kawasaki (JP); Daigoro Kanematsu, Yokohama (JP); Akihiro Kakinuma, Hadano (JP); Asako Watanabe, Kawasaki (JP); Mitsutoshi Nagamura, Tokyo (JP); Akihiro Tomida, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 427 days.

(21) Appl. No.: 12/185,512

(22) Filed: Aug. 4, 2008

(65) Prior Publication Data

US 2009/0040256 A1 Feb. 12, 2009

(30) Foreign Application Priority Data

Aug. 7, 2007 (JP) ..... 2007-205910

(51) Int. Cl.
*B41J 29/393* (2006.01)

(52) U.S. Cl. ..... 347/19

(58) Field of Classification Search ..... 347/15, 347/43, 12, 19

See application file for complete search history.

(56) References Cited

U.S. PATENT DOCUMENTS

| | | | | |
|---|---|---|---|---|
| 6,390,583 | B1 | 5/2002 | Kato et al. | |
| 6,435,654 | B1 * | 8/2002 | Wang et al. | 347/43 |
| 6,450,606 | B1 | 9/2002 | Kato et al. | |
| 6,474,768 | B1 | 11/2002 | Yano et al. | |
| 6,494,557 | B1 | 12/2002 | Kato et al. | |
| 6,505,909 | B1 | 1/2003 | Kato et al. | |
| 7,426,033 | B2 * | 9/2008 | Cumming | 356/402 |
| 2009/0040263 | A1 | 2/2009 | Tomida et al. | |

FOREIGN PATENT DOCUMENTS

| | | |
|---|---|---|
| JP | 2661917 | 6/1997 |
| JP | 10-278311 | 10/1998 |
| JP | 2004-167947 | 6/2004 |

* cited by examiner

*Primary Examiner* — Lamson D Nguyen

(74) *Attorney, Agent, or Firm* — Fitzpatrick, Cella, Harper & Scinto

(57) ABSTRACT

A printing apparatus and a calibration method are provided which, by using a small-capacity memory, can perform a high-speed calibration processing on data used to eject ink of the same color from a plurality of nozzle arrays. By ejecting ink of the same color from the plurality of nozzle arrays, patch is printed and, based on the printed result of the patch, a content of a print data correction processing is changed.

8 Claims, 13 Drawing Sheets

PRINTING APPARATUS AND CALIBRATION METHOD

BACKGROUND OF THE INVENTION

1. Field of the Invention

The present invention relates to an ink jet printing apparatus and a calibration method. More specifically it relates to a printing apparatus with a calibration function to correct color deviations and also to a calibration method.

2. Description of the Related Art

As one output device to print an image on a variety of print media, such as paper, an ink jet printing apparatus is known. In recent years the ink jet printing apparatus has technologically advanced to be able to produce relatively high quality images and thus has come to be used not only for personal printing purpose but also as industrial printing apparatus that produce printed products to be sold as merchandise. So, demands not only for higher image quality of printed images but for improved reproducibility of images are growing year by year and there is also increasing calls for improvements in correcting even slight color deviations or density deviations.

An ink jet printing apparatus of this kind has been known to have a plurality of print heads or a plurality of nozzle arrays (arrays of ejection openings) for the same ink color. This construction enables bidirectional printing, which causes the print heads to print as they move in both forward and backward directions to improve printing speed, and can also prevent color variations of printed images caused by the bidirectional printing. In such a printing apparatus with a plurality of print heads or a plurality of nozzle arrays, however, a desired color of a printed image may not be produced because of variations in ink ejection characteristics among individual print heads or among individual nozzle arrays. Among factors contributing to the ink ejection characteristic variations among print heads or among nozzle arrays are structural variations among ink ejection energy generation elements or among ink ejection nozzles. For example, when electrothermal conversion elements (heaters) are used as the ejection energy generation elements, the factors contributing to the ink ejection characteristic variations include variations in the amount of generated heat among heaters (variations in the film thickness of heaters) and variations in ink ejection opening diameter among nozzles, of which the ink ejection openings form a part. Further, generated heat variations of heaters due to age deterioration and ink viscosity variations due to different environments where ink is used may cause changes in ink ejection volume, resulting in changes in printing characteristics of images.

Calibration is a known technology to deal with color differences caused by ink ejection characteristic variations among nozzle arrays or among print heads. Such calibration technology, for example, changes a γ table used in a γ correction processing as part of the image processing to correct the ink ejection characteristics of print heads. More specifically, this involves printing patches on a print medium by using a plurality of print heads or a plurality of nozzle arrays and, based on the printed patches, changing the γ table used in the γ correction processing to an appropriate setting. Methods for detecting color deviations of the printed patches include a visual check method and a method using an input device such as a scanner.

The visual method, for example, is known to print tertiary patches using three color inks (3 colorants)—C (cyan), M (magenta) and Y (yellow)—to examine the printed patches for color deviations. This method prints tertiary color patches by using C, M, Y inks at a ratio expected to produce an achromatic color and also prints a plurality of patches of almost gray by progressively changing application volumes of these inks. Then, by visually selecting a patch closest to achromatic color from the printed patches, print characteristics of C, M, Y inks are detected (Japanese Patent Laid-Open No. 10-278311).

The input device-based method using, for example, a scanner first prints patches for each of four ink colors—C (cyan), M (magenta), Y (yellow) and K (black)—and reads these patches with the scanner, colorimeter or density meter. It then detects a difference between a reading of each patch and an expected value of that patch and, based on the detected difference, changes a correction value such as γ value to correct colors of a printed image (Japanese Patent No. 2,661,917). There is another method that improves calibration precision by printing two types of patches—solid patterns (solid images) and gradation patterns of C, M, Y, K. Still another method to improve the calibration precision involves printing patches of a secondary color and a tertiary color using C, M, Y, K inks.

Further, a so-called serial scan type printing apparatus has a scanner or optical sensor mounted on a carriage on a printing apparatus body side to read patches. In the printing apparatus body, densities of printed patches are measured for automatic calibration (Japanese Patent Laid-Open No. 2004-167947). In such a printing apparatus, a scanner head to read patches and a print head to eject a plurality of different inks are mounted on a carriage. Upon receiving a calibration execution command, the printing apparatus prints patches on a print medium by ejecting inks of different colors from a print head and measures densities of the patches to calculate a difference (density difference) between a target value of print density and a measured value for each gradation level of each ink color. In this way, a density correction value can be determined for each gradation level of each ink color.

In a printing apparatus having a plurality of print heads or a plurality of nozzle arrays that eject the same color ink, the following method is available to generate binary data corresponding to each nozzle array. The method involves decomposing image data (R, G, B data) generated by a host system (including a host apparatus) into multi-valued data for each ink color and distributing the multi-valued data of the same color ink among a plurality of nozzle arrays before they are binarized. Consider, for example, a case where C (cyan) and M (magenta) ink are each assigned two nozzle arrays (C1, C2 nozzle arrays and M1, M2 nozzle arrays) and where Y (yellow) and K (black) ink are each assigned one nozzle array. In this case, C and M multi-valued data are distributed to the nozzle arrays C1, C2 and nozzle arrays M1, M2, respectively. Then, the distributed multi-valued data for C and M, the multi-valued data for Y and the multi-valued data for K are subjected to the image processing. That is, the multi-valued data distributed to each nozzle array undergoes the γ correction processing using the corresponding table and then the binarization processing for each nozzle array.

In this case, however, since the multi-valued data before binarization is distributed, a complementary relation among a plurality of nozzle arrays of the same ink may not be maintained when the multi-valued data is binarized. To cope with this problem, it is conceivable to keep the complementary relation among nozzle arrays as the multi-valued data for individual nozzle arrays are binarized. This method, however, makes the processing more complex and requires a large amount of memory, increasing the time taken by the processing.

Such image processing poses a similar problem also when the calibration is executed. That is, during the calibration a γ correction table corresponding to each of the nozzle arrays that eject the same color ink is updated. So, when the multi-valued data is binarized according to the updated γ correction table, the complementary relation among the nozzle arrays may not be maintained. Keeping the complementary relation among the nozzle arrays as the multi-valued data for the individual nozzle arrays are binarized will pose a problem of complicating the processing as described above.

Another conceivable method for generating binary data for each nozzle array may involve subjecting image data received from a host system to the image processing (including a color conversion processing or a γ correction processing) to binarized it and distribute the binarized data to individual nozzle arrays. However, the color deviation correction by the γ correction must be performed on the multi-valued data, not on the binarized data. So, the binarized data distributed to individual nozzle arrays needs to be converted into multi-valued data, subjected to the color deviation correction and then binarized again. In that case, because a complicated process of converting the binary data into multi-valued data and then binarizing the multi-valued data again is required, the processing becomes complex. Further, since this method also is required to binarize the multi-valued data for each nozzle array, the processing becomes complicated if the complementary relation among the nozzle arrays is to be kept while the multi-valued data for individual nozzle arrays are binarized.

SUMMARY OF THE INVENTION

In a printing apparatus having a plurality of groups of nozzle arrays that eject the same color ink, the present invention provides a printing apparatus capable of executing a calibration processing at high speed using a small amount of memory and also a calibration method.

In a first aspect of the present invention, there is provided a printing apparatus for printing an image by using a print head having a plurality of nozzle arrays on each of which a plurality of nozzles capable of ejecting ink of the same color are arranged in line, the printing being performed by ejecting ink from the plurality of nozzles according to print data corrected by a correction processing, the printing apparatus comprising: a patch printing unit that prints a patch; and a calibration unit that changes a content of the correction processing according to printed results of the patch; wherein the patch printing unit prints the patch by ejecting ink from the plurality of nozzles arranged on the plurality of nozzle arrays capable of ejecting ink of the same color; and, wherein the calibration unit changes, according to the printed result of the patch, the content of the correction processing used to correct the print data for ejecting ink of the same color.

In a second aspect of the present invention, there is provided a printing apparatus for printing an image by using a print head having a plurality of nozzle arrays on each of which a plurality of nozzles capable of ejecting ink of the same color are arranged in line, the printing being performed image by ejecting ink from the plurality of nozzles according to print data corrected by a correction processing, the printing apparatus comprising: a patch printing unit that prints a patch; and a calibration unit that changes a content of the correction processing according to printed results of the patch; wherein, when a print mode that uses the plurality of nozzle arrays capable of ejecting ink of the same color is selected from among a plurality of print modes, the patch printing unit prints the patch by ejecting ink from the plurality of nozzles arranged on the plurality of nozzle arrays capable of ejecting ink of the same color; and, wherein the calibration unit changes, according to the printed result of the patch, the content of the correction processing used to correct the print data for ejecting ink of the same color.

In a third aspect of the present invention, there is provided a calibration method in a printing apparatus, the printing apparatus printing an image by using a print head having a plurality of nozzle arrays on each of which a plurality of nozzles capable of ejecting ink of the same color are arranged in line, the printing being performed by ejecting ink from the plurality of nozzles according to print data corrected by a correction processing, the calibration method changing a content of the correction processing, the calibration method including: a patch printing step to print patch; and a calibration step to change a content of the correction processing according to printed results of the patch; wherein the patch printing step prints the patch by ejecting ink from the plurality of nozzles arranged on the plurality of nozzle arrays capable of ejecting ink of the same color; and, wherein the calibration step changes, according to the printed result of the patch, the content of the correction processing used to correct the print data for ejecting ink of the same color.

In a fourth aspect of the present invention, there is provided a calibration method in a printing apparatus, the printing apparatus printing an image by using a print head having a plurality of nozzle arrays on each of which a plurality of nozzles capable of ejecting ink of the same color are arranged in line, the printing being performed by ejecting ink from the plurality of nozzles according to print data corrected by a correction processing, wherein an image print mode can be selected from among a plurality of print modes, the calibration method changing a content of the correction processing, the calibration method including: a patch printing step to print patch; and a calibration step to change a content of the correction processing according to printed results of the patch; wherein, when a print mode that uses the plurality of nozzle arrays capable of ejecting ink of the same color is selected from among a plurality of print modes, the patch printing step prints the patch by ejecting ink from the plurality of nozzles arranged on the plurality of nozzle arrays capable of ejecting ink of the same color; and, wherein the calibration step changes, according to the printed result of the patch, the content of the correction processing used to correct the print data for ejecting ink of the same color.

In a fifth aspect of the present invention, there is provided a printing apparatus to perform printing according to binary data corresponding to each of a plurality of nozzle arrays, the plurality of nozzle arrays being adapted to eject a predetermined color ink, the printing apparatus comprising: a control unit that causes a pattern corresponding to a plurality of gradation values of the predetermined color to be printed with ink of the predetermined color ejected from the plurality of nozzle arrays; a measuring unit that measures information about a density of the pattern printed by the control unit; a correction unit that corrects multi-valued data according to the information measured by the measuring unit, the multi-valued data defining printing of the predetermined color; a conversion unit that transforms the multi-valued data corrected by the correction unit into the binary data; and a distribution unit that distributes the binary data converted by the conversion unit to the plurality of nozzle arrays.

With this invention, patches are printed by ejecting the same color ink from a plurality of nozzle arrays and a content of a correction processing on print data is changed according to a result of the printed patches. This enables the calibration processing to be executed at high speed, using a small volume of memory, on those data that are used to eject the same color ink from a plurality of nozzle arrays.

Further features of the present invention will become apparent from the following description of exemplary embodiments (with reference to the attached drawings).

DESCRIPTION OF THE EMBODIMENTS

Now, preferred embodiments of this invention will be described in detail by referring to the accompanying drawings.

First Embodiment

Figure 1:
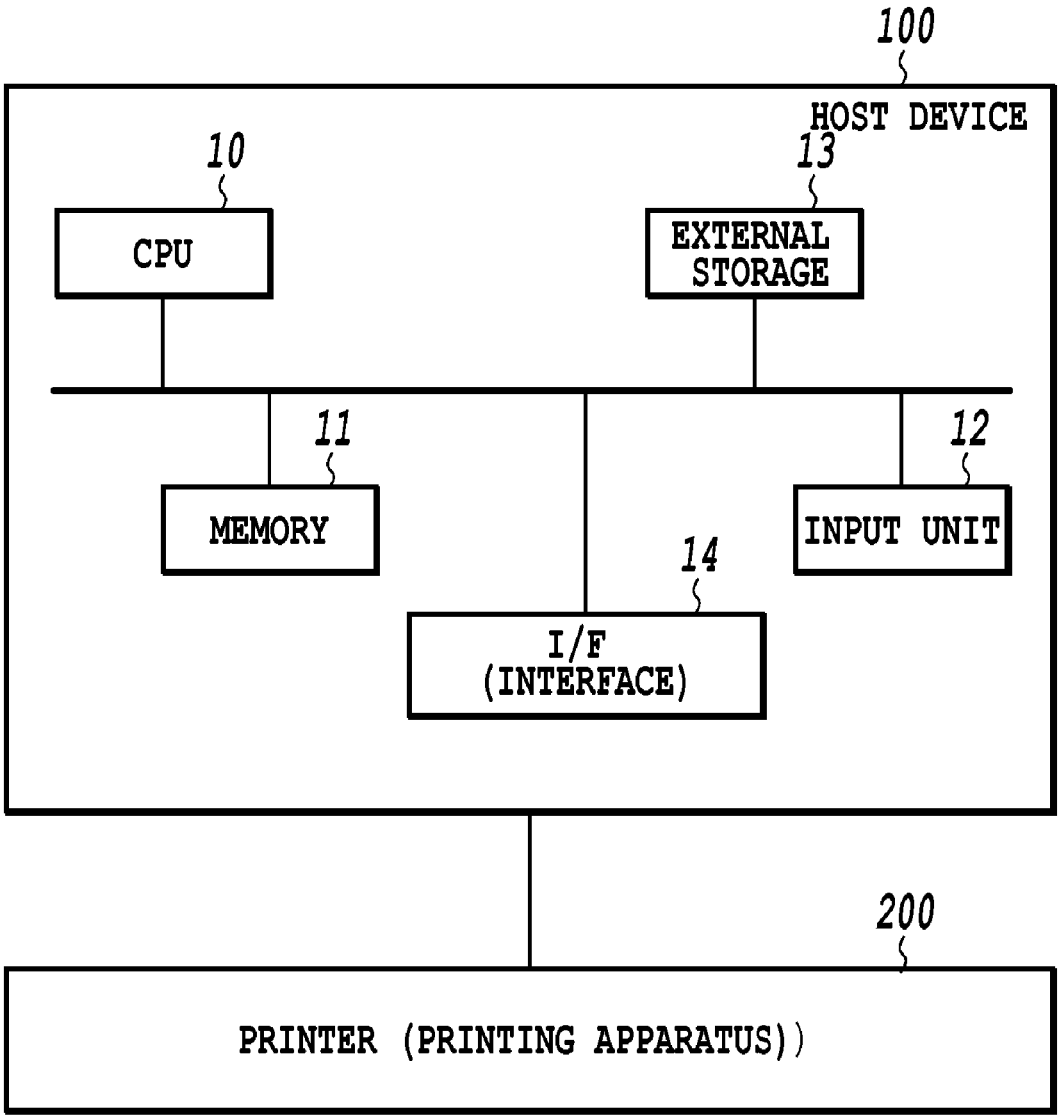
FIG. 1 is a block diagram showing a configuration of a printing system including a printing apparatus of a first embodiment of this invention and a host system.

FIG. 1 is a block diagram showing a configuration of a printing system including a printing apparatus of the first embodiment of this invention and a host system. In FIG. 1, a host device (host) 100 as an information processing device may be a personal computer, digital camera or the like connected to a printer (printing apparatus) 200. The host device 100 has a CPU 10, a memory 11, an external storage 13, an input unit 12 such as keyboard, mouse or the like, and an interface 14 for communication with the printer 200. The CPU 10 executes a variety of operations according to programs stored in the memory 11. These programs are supplied from an external storage such as CD-ROM or stored in the memory 13 in advance.

The host device 100 is connected to the printer 200 through an interface and, as described later, sends to the printer 200 print data of R', G', B' and an image processing table used in an image processing operation.

The printer 200 executes image processing, such as color conversion and binarization, and print characteristic correction processing according to the received image processing information, as described later.

<Printer Construction>

Figure 2:
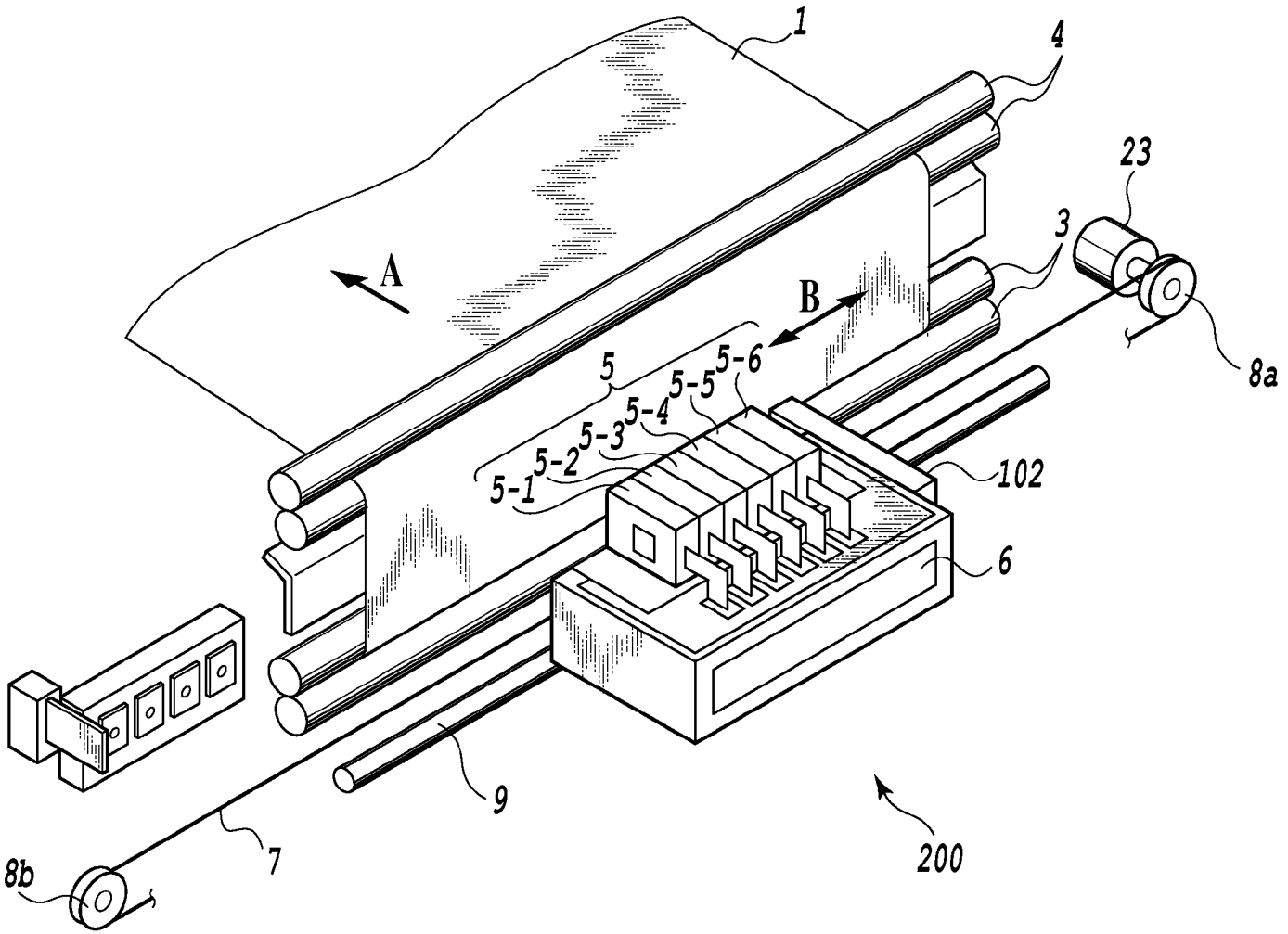
FIG. 2 is a perspective view of the printing apparatus used in the printing system of FIG. 1.

FIG. 2 is a schematic perspective view showing a mechanical construction of the printer 200. In FIG. 2, a plurality of sheets of a print medium 1, such as print paper and plastic sheets, are stacked in a cassette not shown and, during a printing operation, are separated one at a time by a feed roller not shown. The print medium thus fed are moved a predetermined distance by a first transport roller 3 and a second transport roller 4, arranged a predetermined distance apart, in a direction of arrow A (also referred to as a transport direction or sub-scan direction) at a timing corresponding to a scan of the print head. The first transport roller 3 comprises a pair of rollers—a drive roller driven by a stepping motor (not shown) and a follower roller rotated by the drive roller. Similarly, the second transport roller also comprises a pair of rollers. The printer 200 can also print on rolled print medium as well as print paper sheets cut to a predetermined size and stacked in a cassette.

A print head assembly 5 includes an ink jet print head capable of ejecting Y (yellow), M (magenta), C (cyan) and K (black) inks. The print head 5 of this embodiment is formed as an assembly of separate print heads 5-1, 5-2, 5-3, 5-4, 5-5, 5-6. The print heads 5-1 to 5-6 comprising the print head assembly 5 are formed with nozzle arrays 5*a*, 5*b*, 5*c*, 5*d*, 5*e*, 5*f*, respectively, each nozzle array being comprised of a plurality of nozzles arrayed in line. The print head 5 is supplied with inks from an ink cartridge not shown. The print head 5 is driven according to an ejection signal to eject inks of different colors from the nozzles of different nozzle arrays. Each of the nozzles includes an ink path, an ejection opening, and an ejection energy generation element such as electrothermal conversion element (heater) and piezoelectric element. When the electrothermal conversion element is used, for example, the electrothermal conversion element is energized according to the ejection signal to boil the ink in the ink path where the electrothermal conversion element is situated, thus ejecting ink from the ejection opening by the bubble expansion energy.

The print head 5 is removably mounted on a carriage 6. The carriage 6 receives a drive force from a carriage motor 23 through a belt 7 stretched between pulleys 8*a*, 8*b*. Thus, the carriage 6 can be moved reciprocally in a main scan direction of arrow B along with the print head 5. On the side surface of the carriage 6 there is mounted a multipurpose sensor 102, which is used to detect a density of an ink ejected on the print medium 1, a width of the print medium 1, and a distance between the sensor 102 and the print medium 1.

In the above construction, the print head 5 ejects ink according to the ejection signal as it reciprocally moves in the direction of arrow B, to form ink dots on the print medium 1, thus printing an image. The print head 5 moves to a home position, as required, where it is subjected to a recovery operation by a recovery unit that is provided to maintain a normal ink ejection state. The recovery operation maintains the print head 5 in a normal state in which there is no ink ejection failures that caused by clogging of ejection openings or the like. After the printing scan of the print head (scanning as it ejects ink), the print medium 1 is moved a predetermined distance in the direction of arrow A by the pair of transport rollers 3, 4. Repetitively alternating the printing scan of the print head 5 with the print medium feed operation can form an image on the print medium 1.

Figure 3:
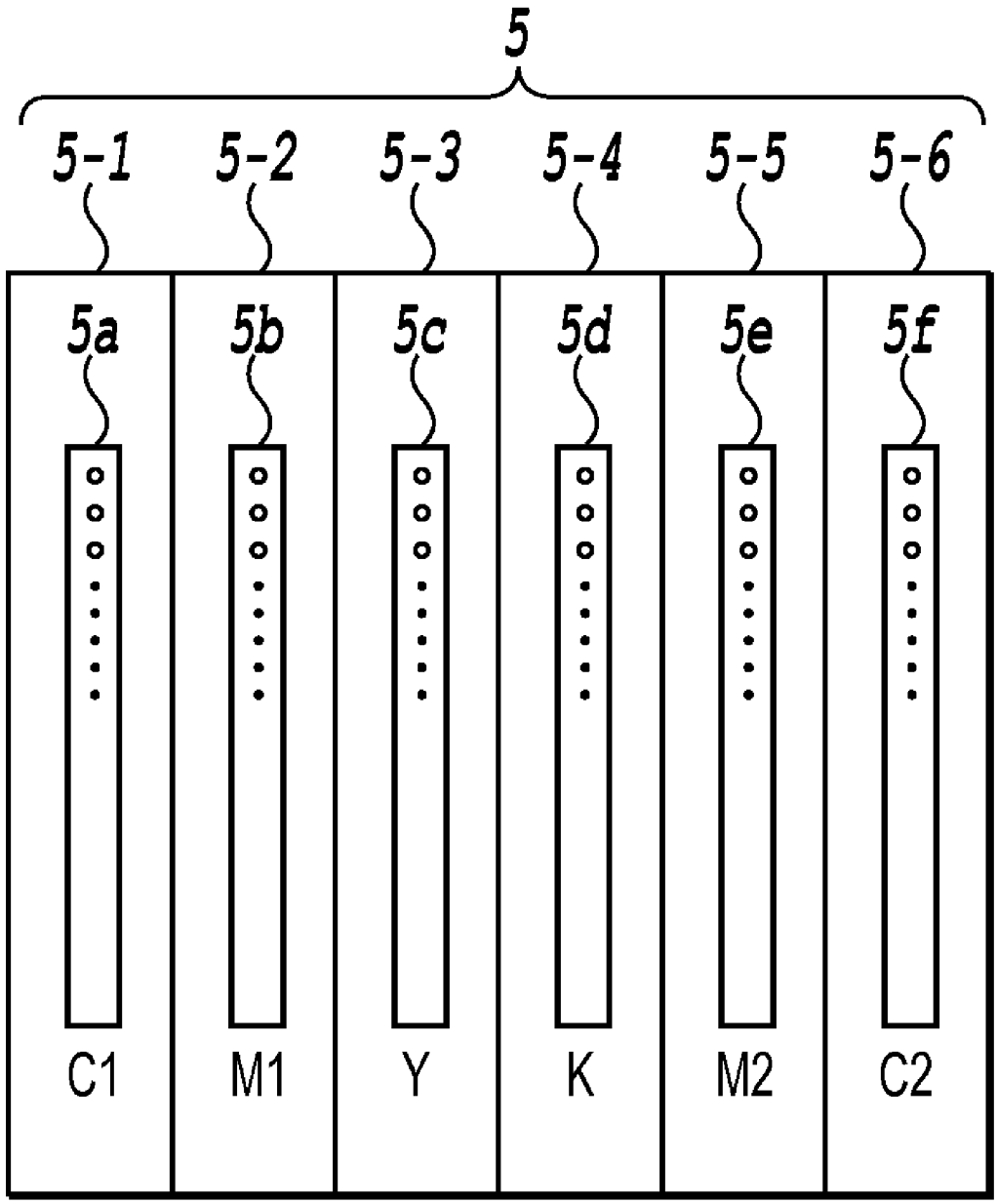
FIG. 3 is a front view showing ejection openings of a print head that can be mounted on the printing apparatus of FIG. 2.

FIG. 3 shows a front view of an ejection face (formed with ejection openings) of the print head 5. In FIG. 3, the print heads 5-1 to 5-6 making up the print head assembly 5 are formed with nozzle arrays 5*a* to 5*f*, respectively. The nozzle arrays 5*a*, 5*f* are supplied a cyan (C) ink; the nozzle arrays 5*b*, 5*e* are supplied a magenta (M) ink; the nozzle array 5*c* is supplied a yellow (Y) ink; and the nozzle array 5*d* is supplied a black (K) ink. For convenience of explanation, the nozzle array 5*a* is referred to as a C1 nozzle array, the nozzle array 5*b* as an M1 nozzle array, the nozzle array 5*c* as a Y nozzle array, the nozzle array 5*d* as a K nozzle array, the nozzle array 5*e* as an M2 nozzle array, and the nozzle array 5*f* as a C2 nozzle array. The kinds of ink colors are not limited to these. The nozzle arrays formed in the print heads 5-1 to 5-6 are not limited to a 1-line nozzle configuration and may be arranged in a 2 or more line nozzle configuration.

As described above, the print head 5 of this embodiment assembles a plurality of print heads 5-1 to 5-6 so that it has a plurality of ink ejection nozzle arrays of different color inks and can print an image by ejecting a plurality of color inks. This embodiment includes, among the plurality of nozzle arrays, nozzle arrays that eject the same color ink, such as C1 and C2 nozzle arrays and M1 and M2 nozzle arrays.

Figure 4:
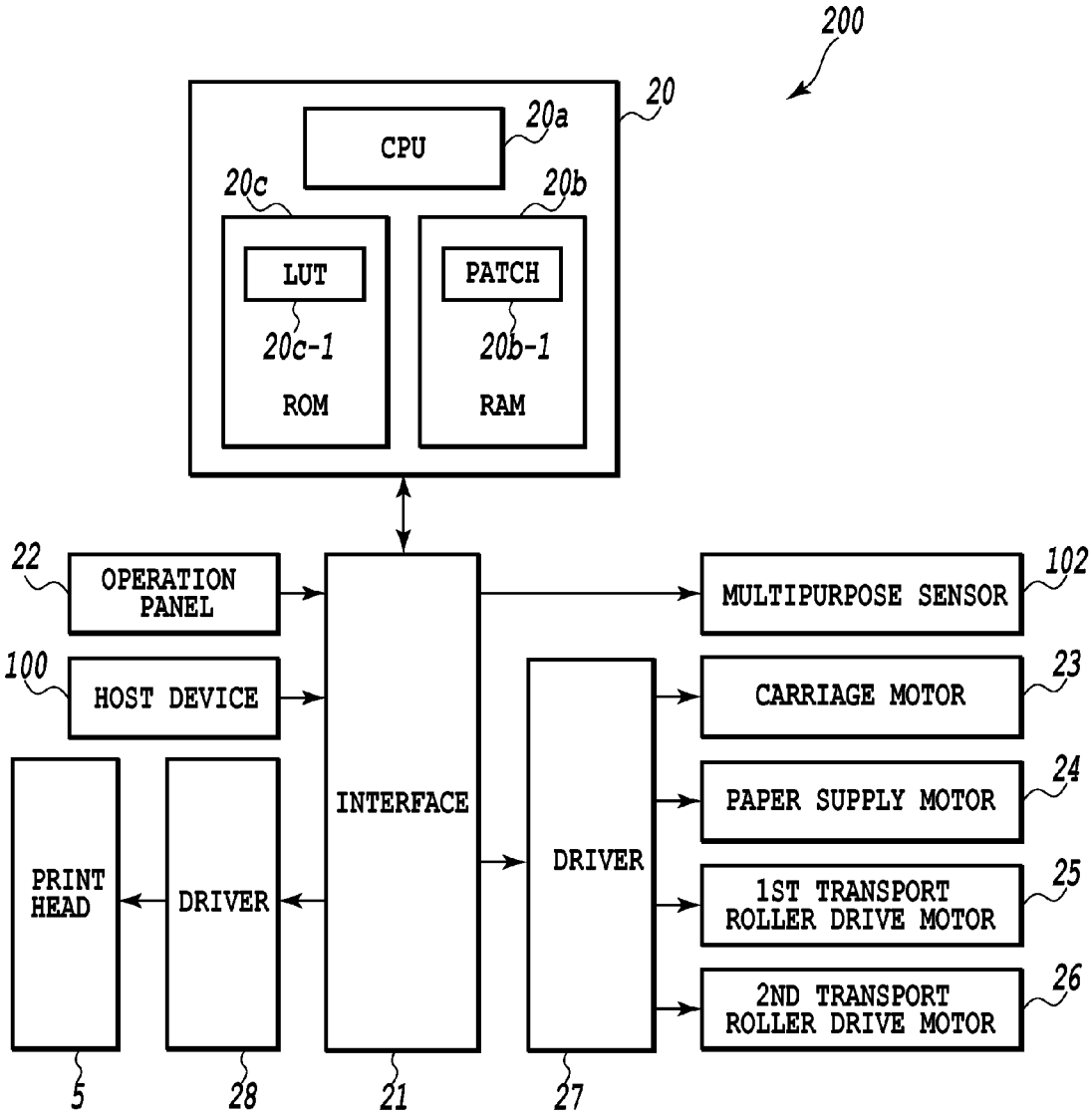
FIG. 4 is a block diagram showing a configuration of a control system of the printing apparatus used in the printing system of FIG. 1.

FIG. 4 is a block diagram showing a configuration of a control system of the printer 200. The control unit 20 of the control system includes a CPU 20*a*, such as microprocessor, and memories, such as a ROM 20*c* and a RAM 20*b*. The ROM 20*c* stores a control program to be executed by the CPU 20*a* and various data such as parameters required for printing operation. The RAM 20*b* is used as a work area for the CPU 20*a* and temporarily stores image data received from the host device and various data such as generated print data. The ROM 20*c* stores an LUT (lookup table) described later with reference to FIG. 7 and the RAM 20*b* stores patch data for printing patches. The LUT may be stored in the RAM 20*b* and the patch data may be stored in the ROM 20*c*.

The control unit 20 executes, through an interface 21, an input/output operation between it and the host device 100 of data and parameters used in printing image data and an input operation of various types of information (e.g., character pitches, character kinds, etc.) from an operation panel 22. The control unit 20 also outputs an ON/OFF signal for driving motors 23-26 through the interface 21. Further, the control unit 20 outputs an ejection signal to a driver 28 to drive the print head to eject inks.

A driver 27, according to an instruction from the CPU 20*a*, drives a carriage drive motor 23, a paper roller drive motor 24, a first transport roller pair drive motor 25 and a second transport roller pair drive motor 26. The driver 28 drives the print heads 5-1 to 5-6.

Next, the multipurpose sensor 102 mounted on the carriage 6 will be explained by referring to FIGS. 5A and 5B.

Figure 5A:
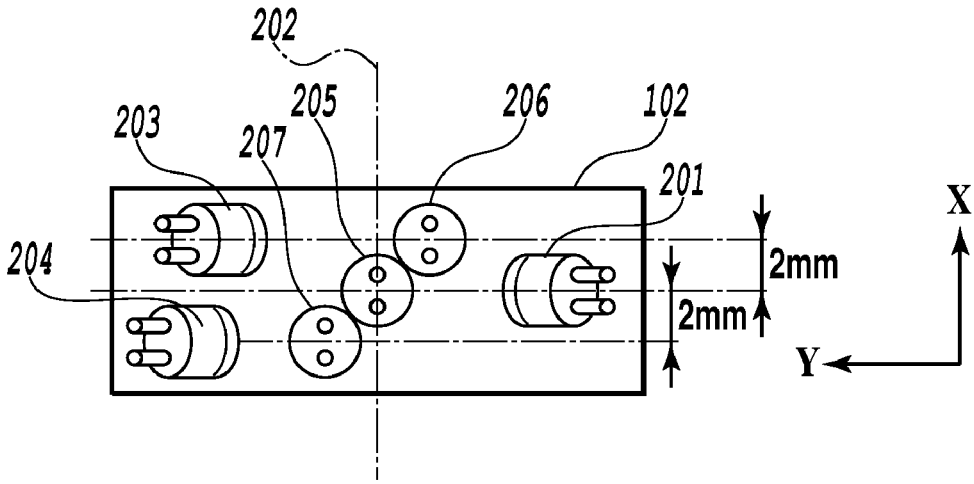
FIG. 5A is a plan view of a multipurpose sensor used in the printing apparatus of FIG. 1.
Figure 5B:
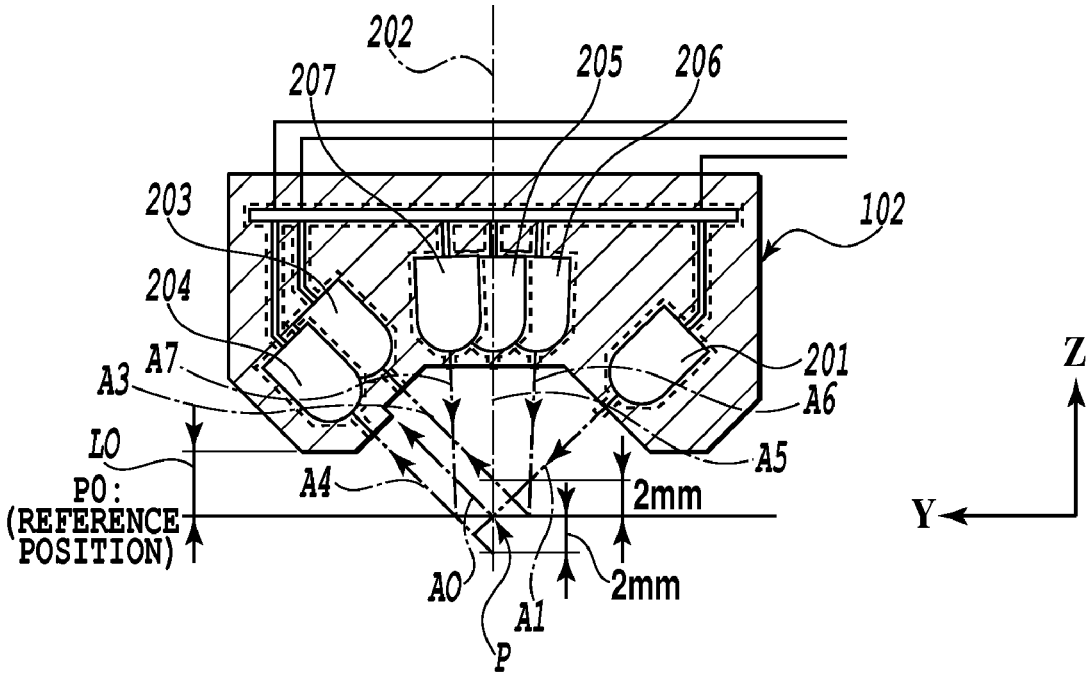
FIG. 5B is a schematic cross-sectional view of the multipurpose sensor.

FIG. 5A and FIG. 5B show a construction of the multipurpose sensor 102. FIG. 5A is a plan view of the multipurpose sensor 102 and FIG. 5B its cross section.

The multipurpose sensor 102 is mounted on the carriage 6 so that it is situated downstream of a print position of the print head 5 in the transport direction of the print medium 1. An undersurface of the sensor 102 is situated at the same level or higher than an undersurface (ejection opening face) of the print head 5 with respect to the surface (print surface) of the print medium 1. The sensor 102 has two phototransistors 203, 204, three visible LEDs 205 and one infrared LED 201 as optical elements and these elements are driven by an external circuit not shown. These elements are of a bullet type element with a maximum diameter of about 4 mm (commonly available mass-production type 3.0-3.1 mm in diameter).

The infrared LED 201 has a radiation angle of 45 degrees with respect to a surface (to be measured) of the print medium 1 that is parallel to an XY plane (a plane defined by X and Y axes). A center (optical axis of a radiated beam hereinafter referred to as a "radiation axis") A1 of an infrared beam radiated from the infrared LED 201 at the radiation angle crosses, at a predetermined position P, a sensor center axis 202 that is parallel to a normal (Z axis) of the surface being measured. With a Z-axis position of the crossing point P taken as a reference position P0, a distance L0 from the sensor 102 to the reference position P0 is defined as a reference distance. The width of the infrared beam radiated from the infrared LED 201 is adjusted by an opening of the sensor 102 for optimization to form a radiation surface (radiation zone) about 4-5 mm in diameter on the surface being measured at a reference position P0.

In this embodiment, a line connecting the center of the radiation zone of the beam radiated from the light emitting element (infrared LED 201 and visible LEDs 205, 206, 207) onto the measured surface and a center of the light emitting element is referred to as an optical axis (radiation axis) of the light emitting element. This radiation axis is also the center of a flux of the radiated light.

Two phototransistors 203, 204 have a light sensitivity in a wavelength range from visible to infrared. Optical axes of beams that the phototransistors 203, 204 receive (reception optical axes), A3, A4, are set parallel to a reflection axis A0 of infrared light (radiated light of infrared LED 201) when the measured surface is at the reference position P0. In this example, the reception optical axis of the phototransistor 203, A3, is set at a position deviated +2 mm in an X direction and +2 mm in a Z direction from the reflection axis A0. The reception axis of the phototransistor 204, A4, is set at a position deviated −2 mm in the X direction and −2 mm in the Z direction from the reflection axis A0. When the surface being measured (measured surface) is at the reference position P0, the optical axis A1 of the infrared LED 201 and a radiation axis A5 of the visible LED 205 cross each other. An optical zone where the two phototransistors 203, 204 receive light (light receiving zone) is at positions on both sides of the crossing point P (at positions on the left and right sides of the crossing point P in FIG. 5B). A spacer about 1 mm thick is held between the two phototransistors 203, 204 so as to prevent received light from wrapping around each other. The sensor 102 has openings to limit zones of incoming light received on the phototransistors and these openings are optimized so that only a reflected light from a receiving zone 3-4 mm in diameter on the measured surface can be received.

In this embodiment, a line connecting a center of a zone (or range) on a measured surface (surface of an object being measured) from which the light receiving element (phototransistors 203, 204) can receive light and a center of the light receiving element is referred to as an optical axis (or light receiving axis) of the light receiving element. This light receiving axis is also a center of a flux of the reflected light that is reflected by the measured surface and received by the light receiving element.

LED 205 is a single color visible LED having a green light emitting wavelength (about 510-530 nm) and set so that its radiation axis A5 aligns with the sensor center axis 202.

LED 206 is a single color visible LED having a blue light emitting wavelength (about 460-480 nm) and, as shown in FIG. 5A, is set at a position deviated +2 mm in the X direction and −2 mm in the Y direction from the visible LED 205. When the surface being measured is at the reference position P0, a radiation axis A6 of the LED 206 and the light receiving axis A3 of the phototransistor 203 cross each other.

LED 207 is a single color visible LED having a red light emitting wavelength (about 620-640 nm) and, as shown in FIG. 5A, is set at a position deviated −2 mm in the X direction and +2 mm in the Y direction from the visible LED 205. When the surface being measured is at the reference position P0, a radiation axis A7 of the LED 207 and the light receiving axis A4 of the phototransistor 204 cross each other.

Figure 6:
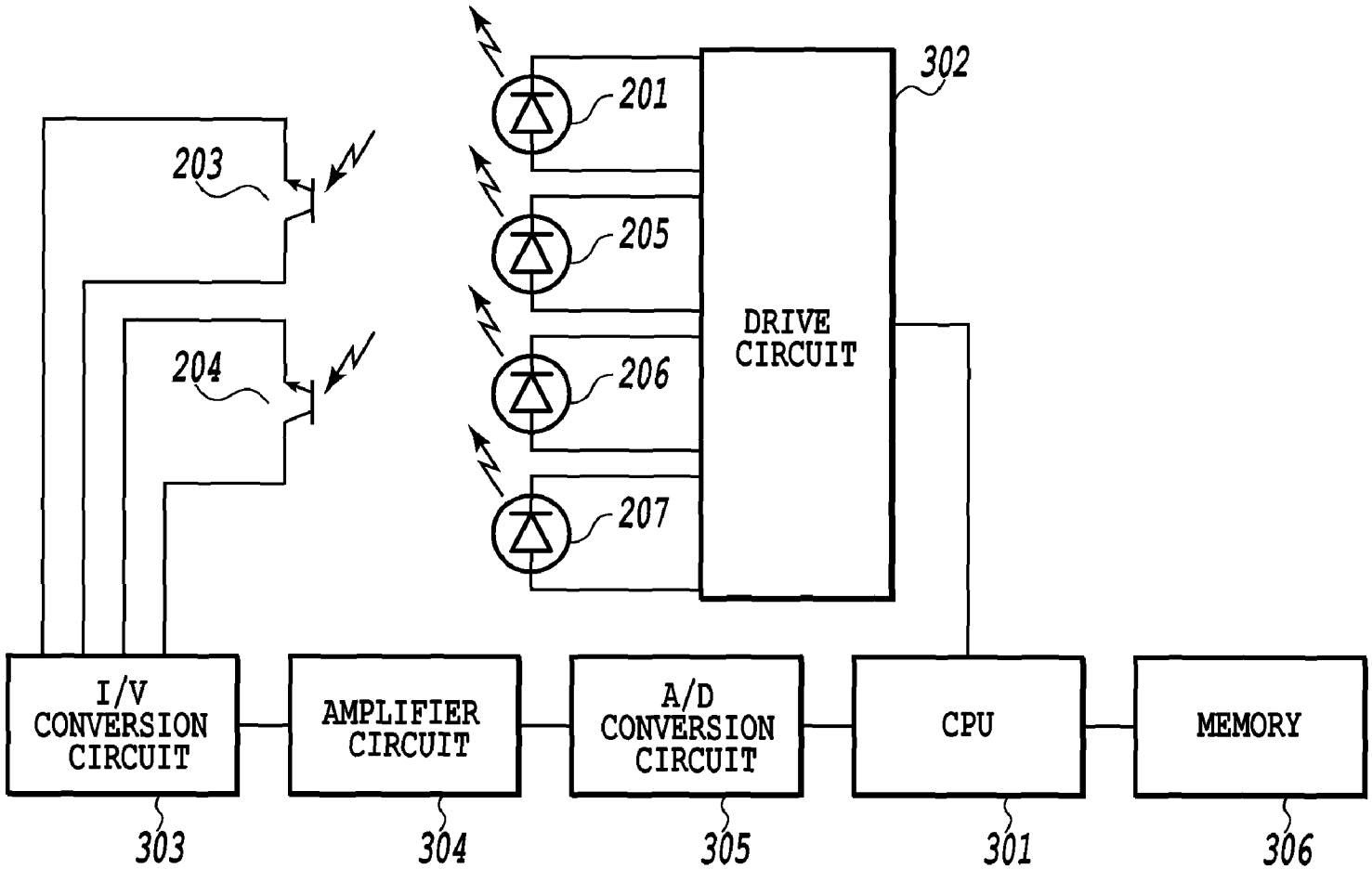
FIG. 6 is an explanatory diagram of a control circuit for processing input/output signals of the multipurpose sensor of FIG. 5.

FIG. 6 is a schematic diagram of a control circuit to process an input/output signal to and from the multipurpose sensor 102 of this embodiment. CPU 301 outputs ON/OFF control signals to the infrared LED 201 and the visible LEDs 205-207 and executes arithmetic operations on output signals according to amounts of light received by the phototransistors 203, 204. A drive circuit 302, when it receives an ON signal from the CPU 301, supplies a constant current to light emitting elements (infrared LED 201 and visible LEDs 205-207) to turn them on. The drive circuit 302 also adjusts the quantities of light produced by the individual light emitting elements so that the amounts of light received by the light receiving elements (phototransistors 203, 204) are at predetermined levels. An I/V conversion circuit 303 transforms output signals of the phototransistors 203, 204 in the form of current values into voltage signals. An amplifier circuit 304 amplifies the transformed output signal (weak voltage signals) to an optimum level. An A/D conversion circuit 305 converts an output signal amplified by the amplifier circuit 304 into a 10-bit digital signal before supplying it to the CPU 301. A memory (e.g., nonvolatile memory) 306 stores a reference table for extracting desired measurements from calculation results produced by the CPU 301, and is also used for temporary storage of output values. The CPU 20*a* and RAM 20*b* of the printing apparatus may be used as the CPU 301 and the memory 306.

Next, an image processing method to generate print data for use in the printer 200 by using the host device 100 and the printer 200 will be explained.

Figure 7:
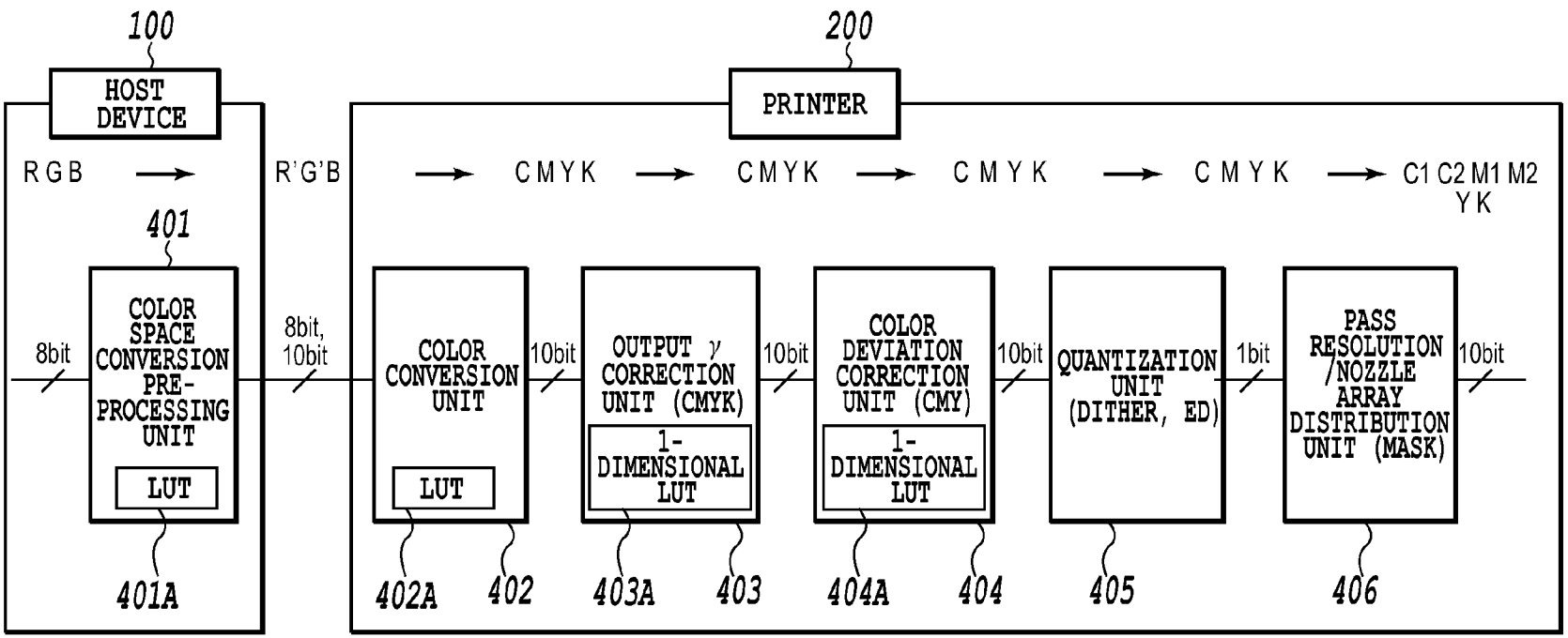
FIG. 7 is an explanatory diagram showing a flow of processing of image data in the printing system of FIG. 1.

FIG. 7 is a block diagram showing a configuration of an image processing unit in this embodiment. In the image processing of this embodiment, the image processing unit receives 8-bit (256-gradation) image data (brightness data) for each color—red (R), green (G) and blue (B). Then, according to this image data the image processing unit outputs 1-bit image data (print data) to a C1 nozzle array, C2 nozzle array, M1 nozzle array, M2 nozzle array, Y nozzle array and K nozzle array to eject inks from their nozzles. The colors and their gradations are not limited to the above.

First, in the host device 100, the image data in the form of 8-bit brightness data for each of R, G, B colors is subjected to color space conversion preprocessing by a color space conversion preprocessing unit (also called a "precedent color processing unit") 401 using a 3-dimensional LUT 401A. This color space conversion preprocessing transforms 8-bit image data for each color into 8- or 10-bit R', G', B' data. This color space conversion preprocessing (also called "precedent color processing") corrects a difference between a color space of an input image represented by the R, G, B image data and a color space reproducible with the printer 200.

Data for each of R', G', B' colors after being subjected to the precedent color processing is sent to the printer 200 where it undergoes color conversion processing performed by a color conversion processing unit (also called a "subsequent color processing unit") 402 using a 3-dimensional LUT 402A. This color conversion processing transforms data for each of the R', G', B' colors into 10-bit data for each of C, M, Y, K colors. This color conversion processing (also called "subsequent color processing") transforms the input image data (RGB image data) represented by brightness data into output image data (CMYK image data) to be represented by a density signal. The input image data is often generated by an additive color mixing of three primary colors (RGB) used on a light emitting body such as display or the like. The output system, such as printer or the like, employs a subtractive color mixing of three primary colors (CMY) that represents colors by light reflection. Thus, the above-described color conversion processing is performed.

For the 3-dimensional LUTs 401A, 402A used by the precedent color processing unit 401 and the subsequent color processing unit 402, data represented by combinations of colors is prepared. For example, data is prepared only for those points (representative points) in a 3-dimensional color space that are arranged at predetermined intervals. If table data corresponding to all combinations of 10-bit data is prepared for each color, the data volume of the 3-dimensional LUTs becomes prohibitively large. So, to minimize a required memory capacity, only those data for the representative points is prepared. For other than the representative points, the conversion to the 10-bit data is performed by using an interpolation technique, which is commonly known.

Next, for 10-bit data for C, M, Y, K colors that has undergone the subsequent color processing, an output γ correction processing is performed by an output γ correction unit 403 using a 1-dimensional LUT 403A corresponding to each color. Normally, a relation between the number of ink dots formed in unit area of a print medium and a print characteristic such as reflection density or the like obtained by measuring a printed image is not linear. So, the 10-bit input gradation level for each of the C, M, Y, K colors is corrected by the output γ correction processing to make linear the relation between the 10-bit input gradation level of C, M, Y, K colors and the gradation level of the printed image.

Generally, an output γ correction table (1-dimensional LUT) 403A is generated for those print heads having a standard ink ejection characteristic. However, as described earlier, since there are variations in ink ejection characteristic among print heads, it is difficult with the print head output γ correction table alone to achieve appropriate output results in every printing apparatus that uses print heads with characteristic variations.

Therefore, in this embodiment, for the C, M, Y, K 10-bit data that has undergone the output γ correction processing, a color deviation output γ correction is performed using a color deviation correction 1-dimensional LUT 404A corresponding to each color. An optimal 1-dimensional LUT 404A is set based on information about color deviations caused by combinations of print characteristics of three ink colors C, M, Y. Then, when an instruction to start a calibration (described later) on the set LUT 404A is issued, the calibration is executed based on a detection signal of the multipurpose sensor 102. This calibration corrects the LUT 404A or reselects a table.

Figure 8:
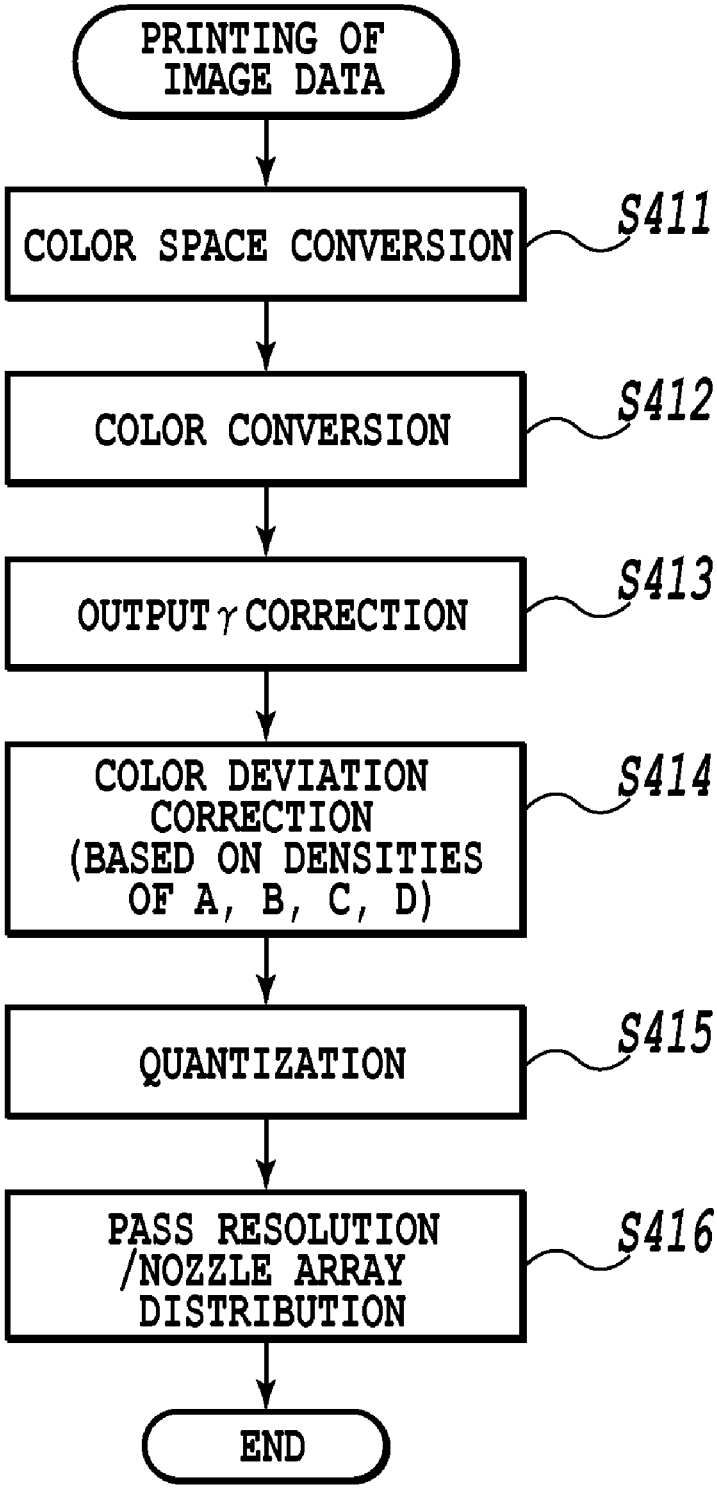
FIG. 8 is a flow chart showing detailed processing of image data in FIG. 7.

FIG. 8 is a flow chart showing a flow of image data processing. Image data is subjected to a color space conversion processing (step S411) by the color space conversion preprocessing unit 401 and to a color conversion processing (step S412) by the color conversion processing unit 402. Then, the processed image data further undergoes an output γ correction processing by the output γ correction unit 403 and a color deviation correction processing (step S414) by the color deviation correction unit 404.

Then, the data is subjected to a quantization processing (step S415) by a quantization unit 405 and to a pass resolution and nozzle array distribution processing (step S416) by a pass resolution and nozzle array distribution unit 406.

Since the printer 200 of this embodiment is a binary printing apparatus that prints an image based on binary data representing ink ejection or non-ejection, the quantization processing (step S415) transforms the 10-bit data for each of C, M, Y, K colors into 1-bit binary data for each of C, M, Y, K colors. After the binarization processing, the 1-bit print data is distributed to nozzle arrays by using mask patterns (step S416). In a print mode (multi-pass print mode) where a predetermined area on a print medium is completely printed by a plurality of passes of the print head, the print data is resolved into passes (step S416). In that case, pass mask patterns having combined functions of the pass resolution and the nozzle array distribution can be used.

In this embodiment, 1-bit data of C quantized by step S415 is resolved into print data for C1 nozzle array and print data for C2 nozzle array. 1-bit data of M quantized by step S415 is resolved into print data for M1 nozzle array and print data for M2 nozzle array. As to 1-bit data of Y and K binarized by step S415, the nozzle array distribution processing is not performed and the 1-bit data is sent as is, as print data for nozzle array Y and print data for nozzle array K. In this embodiment, an error diffusion method (ED) is used as a binarization technique. Other methods such as a dither method or the like may also be used.

The 1-dimensional LUT 403A used for the output γ correction processing and the 1-dimensional LUT 404A used for color deviation correction processing may be combined to generate one LUT. This combined LUT may be used instead of the two LUTs. That is, by performing the color deviation correction on the output γ correction table (1-dimensional LUT 403A) for a print head that has a standard ejection characteristic, an output γ correction table (1-dimensional LUT) 403'that combines the 1-dimensional LUTs 403A and 404A is generated. In the following description, a processing that combines the output γ correction processing (step S413) and the color deviation correction processing (step S414) is referred to also as a color deviation correction processing. As described above, the 10-bit data for each of C, M, Y, K colors that has undergone the subsequent color processing (step S412) can be subjected to the output γ correction processing and the color deviation correction processing at one time by using the 1-dimensional LUT 403' for each color. In that case, since the color deviation correction processing is performed in the output γ correction processing (step S413), it is possible to eliminate the color deviation correction unit 404 and the color deviation correction processing (step S414).

Next, the calibration will be explained.

When a command to start the calibration is entered from the input unit 12 or CPU 10 of the host device 100 or from the operation panel 22 of the printing apparatus 200, or the like, the CPU 20*a* of the printing apparatus 200 drives the paper supply motor 24 to start supplying the print medium 1 from the paper supply tray. After the print medium 1 is fed to a region where it can be printed by the print head 5, a print medium feed operation in the sub-scan direction and a printing scan by the print head 5 are alternated repetitively. The printing scan is an operation by which the print head 5 is made to eject ink according to the print data as the carriage 6 is moved in the main scan direction by the carriage motor 23. In this embodiment, the print medium feed operation and the print head printing scan are alternated repetitively to print the required number of patches (test patterns or patterns) for calibration.

Figure 9:
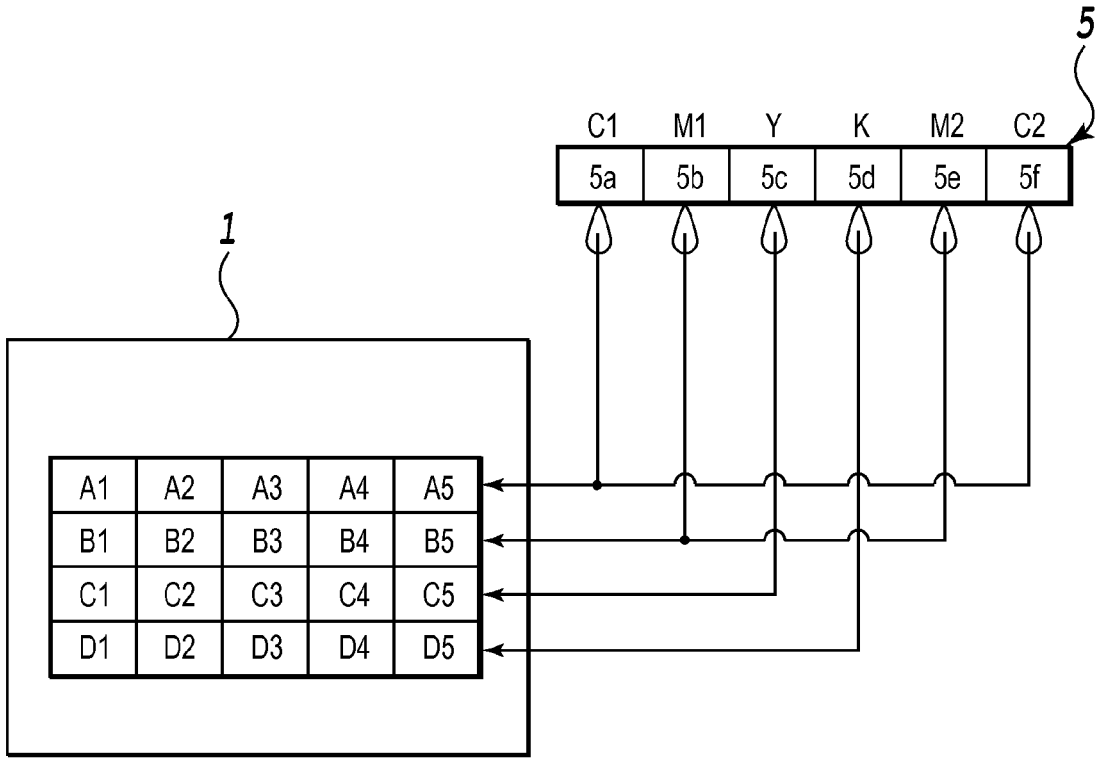
FIG. 9 is an explanatory diagram showing a correspondence between nozzle arrays and patches.

FIG. 9 is an explanatory diagram showing a relationship between patches printed on the print medium 1 and inks ejected from the print head 5.

A1-A5 represent color patches printed by C (cyan) ink; B1-B5 represent color patches printed by M (magenta) ink; C1-C5 represent color patches printed by Y (yellow) ink; and D1-D5 represent color patches printed by K (black) ink. In these patches A1-A5, B1-B5, C1-C5 and D1-D5, the attached numbers 1-5 indicate that there are five values (ranks) in a gradation (corresponding to print density) level. The patch A, for example, comprises five patches A1-A5 with different densities corresponding to five gradation values. The same can also apply to other patches. Such gradation values are not limited to five values (five ranks) and the attached numbers 1-5 to the patches do not need to be related to the gradation values.

The patches A (A1-A5) are printed by C (cyan) ink ejected from the two nozzle arrays 5*a*, 5*f*. The patches B (B1-B5) are printed by M (magenta) ink ejected from the two nozzle arrays 5*b*, 5*e*. The patches C (C1-C5) are printed by Y (yellow) ink ejected from the nozzle array 5*c*. The patches D (D1-D5) are printed by K (black) ink ejected from the nozzle array 5*d*.

Figure 10:
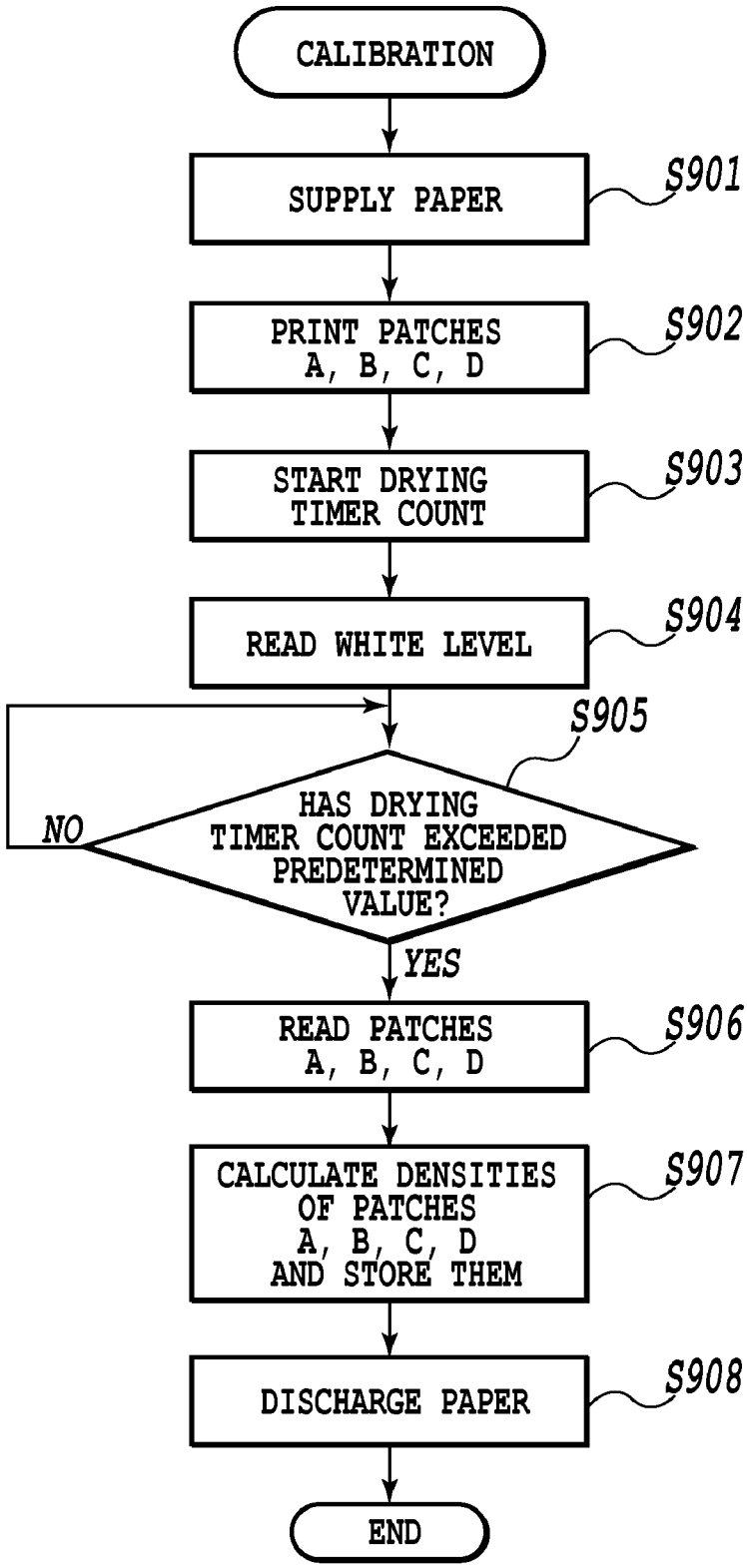
FIG. 10 is a flow chart showing processing performed by the printing apparatus, from a start of patch printing to a density measurement.

FIG. 10 is a flow chart showing an operation of the printer 200 from the start of patch printing to the measurement of density after the calibration execution demand is issued.

When an instruction to execute the calibration operation is entered from the host device or from the operation panel of the printing apparatus, a print medium is supplied (S901) for patch printing. Then, the print head 5 as a patch printing means prints patches A, B, C, D (patch printing step (S902)). As described earlier, the patches A are printed by the two nozzle arrays C1, C2 (5*a*, 5*f*) and the patches B are printed by the two nozzle arrays M1, M2 (5*b*, 5*e*). Further, the patches C are printed by the Y nozzle array (5*c*) and the patches D by the K nozzle array (5*d*).

When the patches A are printed by ejecting C ink from the C1 nozzle array and C2 nozzle array, percentages of inks ejected from the two nozzle arrays are the same as the percentages when the printer 200 prints a desired image. If the printer 200 performs bidirectional printing in forming the desired image, the C1 and C2 nozzle arrays are used differently during a forward scanning in which the print head moves in the forward direction and during a backward scanning in which the print head moves in the backward direction, in order to prevent uneven color in the printed image. For example, during the forward scanning, inks are ejected from C1, M1, Y and K nozzle arrays and, during the backward scanning, the inks are ejected from C2, M2, K and Y nozzle arrays. When the patches A are printed, the C ink is ejected from the C1 nozzle array and the C2 nozzle array in the same percentages as those of such bidirectional printing. The percentages in which the C ink is ejected from the C1 and C2 nozzle arrays are the same for any of a plurality of patches A1-A5 with different gradation values. The densities of the patches A1-A5 can be adjusted by using masks.

Similarly, when the M ink is ejected from the M1 nozzle array and the M2 nozzle array, the percentages of ink ejected from these nozzle arrays are equal to those when the printer 200 prints the desired image. The densities of the patches B1-B5 can also be adjusted by using masks.

Next, to set drying times of the printed patches A, B, C, D, a drying timer counter is started (S903). Then, a reflection brightness of a ground color (white level) of blank portions on the print medium 1 that are not printed with the patches A, B, C, D is started to be measured using the sensor 102 (S904). White level measurements are used as reference values (reference white) in calculating densities of patches to be printed. So, the white level measurements are stored for each light receiving element (phototransistor) used for measurement the white level. The white level corresponds to the density of a ground color of a blank portion on the print medium where no patches are printed, and the ground color is white when the print medium is white. In this embodiment, a case where a print medium with a white ground is used is taken for explanation.

After the count value of the drying timer is confirmed to have exceeded a predetermined time, the measurement of reflection brightness of patches A, B, C, D is started (S905, S906). In taking measurements of the reflection brightness, one of the LEDs 205, 206, 207 mounted in the sensor 102 that is suited to the ink color of the patch being measured is illuminated. Then, the reflected light from the patch is read by the phototransistors 203 and 204 as patch density measuring means. The LED 205 with a green light emitting wavelength is turned on, for example, when measuring the reflected light from the patch B printed with M ink and when measuring the reflected light from the blank portion (white) of the print medium not printed with patches. The LED 206 with a blue light emitting wavelength is illuminated, for example, when measuring the reflected light from the patches C and D printed with Y ink and K ink and when measuring the reflected light from the blank portion (white) of the print medium not printed with patches. The LED 207 with a red light emitting wavelength is turned on, for example, when measuring the reflected light from the patch A printed with C ink and when measuring the reflected light from the blank portion (white) of the print medium not printed with patches.

After the reflected light from the patches A, B, C, D has been measured, densities of the patches A, B, C, D are calculated from the reflected light measurements of the patches and the reflected light measurements of the blank portions (white). The density values of the patches are stored in the memory 306 or RAM 20*b* in the printer body (S907). The reflected light measurements of the patches are influenced by the reflected light from the blank portions (white). So, the densities of the patches A, B, C, D are calculated by taking such influences into consideration. Then, the print medium is discharged (S908) before terminating the processing.

In the calibration, the content of color deviation correction processing (S414) is changed according to the measured densities of the patches (also referred to as "measured density"). In this embodiment, the table (1-dimensional LUT) 404A used in the color deviation correction processing is corrected.

More specifically, the measured density of each patch and a predetermined target density are compared and a density correction value is calibrated so as to get the measured density value to come near the target value. It is also possible to print patches beforehand by using a high-precision ink jet printing apparatus and print head, measure densities of the patches and then adopt the measured densities as a target value. The target value therefore is very close to an ideal value.

Then, in response to the calibration of the density correction values, the CPU 10 of the host device 100 or the CPU 20*a* (table setting means) of the printer 200 generates a correction LUT (1-dimensional LUT 404A) (table setting process). The 1-dimensional LUT 404A is generated for each kind of print medium or for each image resolution and stored in the memory of the printer body. It is also possible to prepare different 1-dimensional LUTs 404A for different environments of use. In this way, based on the measured density values of the printed patches, a table (1-dimensional LUT 404A) is set.

It is also possible to select from among prepared tables (1-dimensional LUTs 404A) according to the measured density values of the patches. If a C, M, Y ink ejection characteristic balance in the print head 5 is not preferable when compared with a balance of a print head that exhibits a proper ink ejection characteristic, a 1-dimensional LUT 404A is selected so as to get the C, M, Y ejection characteristic to come close to the correct ejection characteristic. Suppose, for example, a print head has an ejection characteristic by which the print head ejects C ink in a volume somewhat greater than required. In that case, from among a plurality of color deviation 1-dimensional LUTs 404A with different correction values, an LUT that provides an output value somewhat lower than normal for an input value is selected or set as a correction LUT for C ink. Executing the calibration that selects or sets a 1-dimensional LUT 404A in this way ensures that, when a print head that ejects a somewhat greater volume of C ink than necessary is used, a corresponding output for C ink ejection is corrected to a smaller value. As a result, even if a print head that ejects a somewhat greater volume of C ink than necessary is used, the same color as that produced by a print head with a standard print characteristic can be reproduced. Therefore, a balance of C, M, Y ink ejection characteristic of the print head can be kept in an appropriate state.

As described above, in the calibration process of this embodiment, patches are printed by ejecting ink from those nozzle arrays that eject the same color ink. Since the number of patches printed in one calibration process and the number of gradation ranks of multi-valued image data match, the multi-valued image data can be subjected as is to the calibration. This enables the color deviation correction in the image data processing to be performed on the multi-valued image data before being distributed to nozzle arrays. Then, the color deviation-corrected image data is binarized and distributed to the nozzle arrays.

Binarizing the image data and distributing the binarized image data to nozzle arrays after the color deviation correction processing can maintain the complementary relation among a plurality of nozzle arrays. This obviates the need to execute the color deviation correction processing on the binarized image data after distributing the binarized image data to the nozzle arrays. Hence, it is not necessary to perform wasteful processing, such as distributing binarized image data to nozzle arrays and returning the binarized data to multi-valued data before executing the color deviation correction processing, or binarizing the multi-valued data after the color deviation correction processing. This prevents the image processing from becoming complex, which in turn obviates the need to use a large-capacity memory for this processing, allowing the calibration to be executed at high speed.

Further, the calibration process also considers differences in the ink volume and print density among a plurality of nozzle arrays that eject the same color ink. For example, consider a case where, of the two nozzle arrays that eject the same color ink, one has arranged in line a plurality of large nozzles with large ejection opening diameters and the other has arranged in line a plurality of small nozzles with small ejection opening diameters. In that case, the ink ejection volume and the print density differ between these two nozzle arrays. In the calibration process of this embodiment, patches are printed with ink ejected from the large nozzles and from the small nozzles. That is, the patches are printed with ink droplets of the same color with different ejection volumes and different print densities and then, based on the printed patches, the calibration is performed. As a result, an appropriate calibration can be done which considers a difference between a print density produced by a nozzle array of large nozzles and a print density produced by a nozzle array of small nozzles. As described above, based on the measured density values of the patches printed by a plurality of nozzle arrays ejecting the same color ink, the density correction value (1-dimensional LUT 404A) is calibrated. Then, the image data is corrected by using the calibrated density correction values, and is quantized and distributed to a plurality of nozzle arrays, thus allowing an image of correct color to be printed.

While in this embodiment the LUTs 402, 403, 404 are kept in the printer 200, they may be stored in the ROM 20*c* or RAM 20*b* beforehand. If these LUTs are stored in the ROM 20*c*, it is desired that a plurality of LUTs is prepared in advance for each purpose of use so that an appropriate LUT can be selected and used.

Second Embodiment

Next, by referring to FIGS. 11-13, a second embodiment of this invention will be described. Constitutional parts identical with those of the first embodiment are assigned like reference numbers and their explanations are omitted. Only those parts different from the first embodiment will be explained.

In the first embodiment, all nozzle arrays have been described to be used in printing an image. In the second embodiment of this invention, a nozzle array to be used is chosen according to a print mode and thus the nozzle array used varies from one print mode to another.

In this example, a print mode 1 prints an image by using C1 nozzle array, C2 nozzle array, M1 nozzle array, M2 nozzle array, Y nozzle array and K nozzle array. A print mode 2 prints an image by using C1 nozzle array, M1 nozzle array, Y nozzle array and K nozzle array. Each of the nozzle arrays does not need to have nozzles arranged in a single line but may have nozzles arranged in two or more lines. That is, each nozzle array may be comprised of two or more nozzle arrays.

Figure 11:
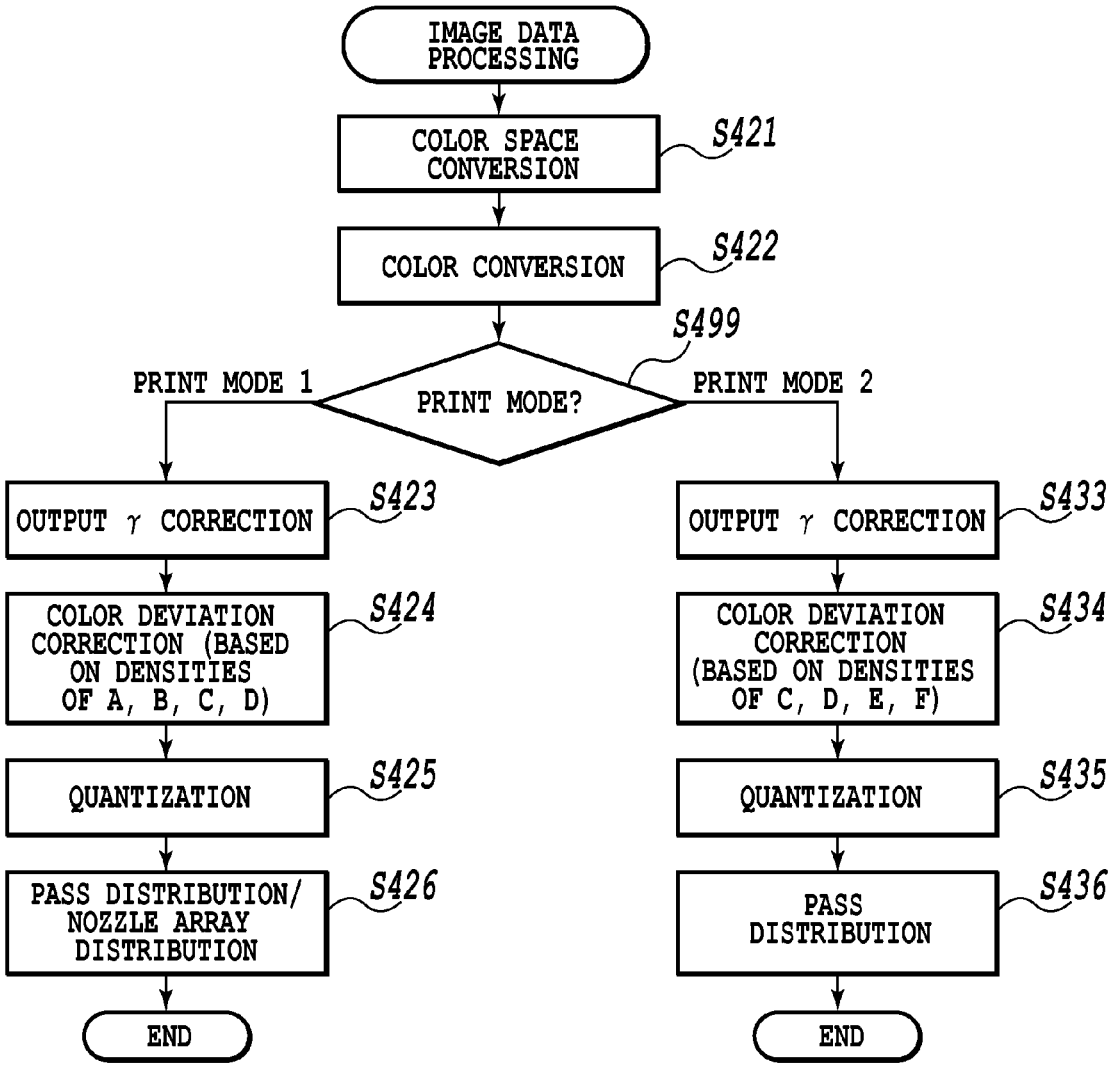
FIG. 11 is a flow chart showing processing of image data in a second embodiment of this invention.

FIG. 11 is a flow chart showing a flow of image data processing performed in this embodiment. The flow of processing branches according to a print mode that is selected depending on image printing conditions.

Image data is subjected first to a color space conversion processing by step S421 and then to a color conversion processing by step S422. Then, in a print mode decision process, step S499 checks a set print mode. A print mode suited for the printing condition is set by a print mode setting means such as the operation panel 22 or CPU 20*a* in the printer 200. According to the set print mode, nozzle arrays to be used for image printing are determined and nozzle arrays to be calibrated are also determined. When the print mode 1 is set, the processing moves from step S499 to step S423; and when the print mode 2 is set, the processing moves from step S499 to step S433.

First, an explanation will be given to a case where the print mode 1 is set.

The output γ correction processing is performed at step S423 before the color deviation correction processing is executed by step S424. To perform the step S423 and step S424 at the same time, it is possible, for example, to combine the correction LUT (1-dimensional LUT) 404A with the output γ correction table (1-dimensional LUT) 403A transferred from the host computer (host device) and use the combined table as the output γ correction table (1-dimensional LUT) 403A.

The image data that has undergone the color deviation correction processing at step S424 is subjected to a quantization operation (binarization) at step S425 and then to a pass resolution/nozzle array distribution processing at step S426.

Image data of C, M, Y and K are, as described later, subjected to the color deviation correction processing (S424) using the density correction value (1-dimensional LUT 404A) that has been calibrated according to printed results of patches A (A1-A5), B (B1-B5), C (C1-C5) and D (D1-D5). The image data is then binarized (S425). The binarized C image data is distributed as print data to the C1 nozzle array and the C2 nozzle array (S426). Similarly, the binarized M image data is distributed as print data to the M1 nozzle array and the M2 nozzle array (S426). The binarized Y image data is sent as is, as print data, to the Y nozzle array. Similarly, the binarized K image data is sent as is, as print data, to the K nozzle array.

The print head ejects inks from the nozzle arrays C1, C2, M1, M2, Y and K, based on these print data, thus printing a desired image.

Next, a case where the print mode 2 is set will be explained.

In the print mode 2, as in the print mode 1, the output γ correction processing is performed at step S433 before the color deviation correction processing is executed by step S434. To perform the step S433 and step S434 at the same time, it is possible, for example, to combine the correction LUT (1-dimensional LUT) 404A with the output γ correction table (1-dimensional LUT) 403A transferred from the host computer (host device) and use the combined table as the output γ correction table (1-dimensional LUT) 403A.

The image data that has undergone the color deviation correction processing at step S434 is subjected to a quantization processing (binarization) at step S435 and then to a pass distribution processing at step S436.

Image data of Y, K, C, and M are, as described later, subjected to the color deviation correction processing (S434) using the density correction value (1-dimensional LUT 404A) that has been calibrated according to printed results of patches C (C1-C5), D (D1-D5), E (E1-E5) and F (F1-F5). The image data is then binarized (S435). The binarized Y image data is sent as is, as print data, to the Y nozzle array. Similarly, the binarized K image data is sent as is, as print data, to the K nozzle array. The binarized C image data is sent as print data to the C1 nozzle array. The binarized M image data is sent as print data to the M1 nozzle array.

The print head ejects inks from the nozzle arrays C1, M1, Y and K, based on these print data, thus printing a desired image.

Figure 12:
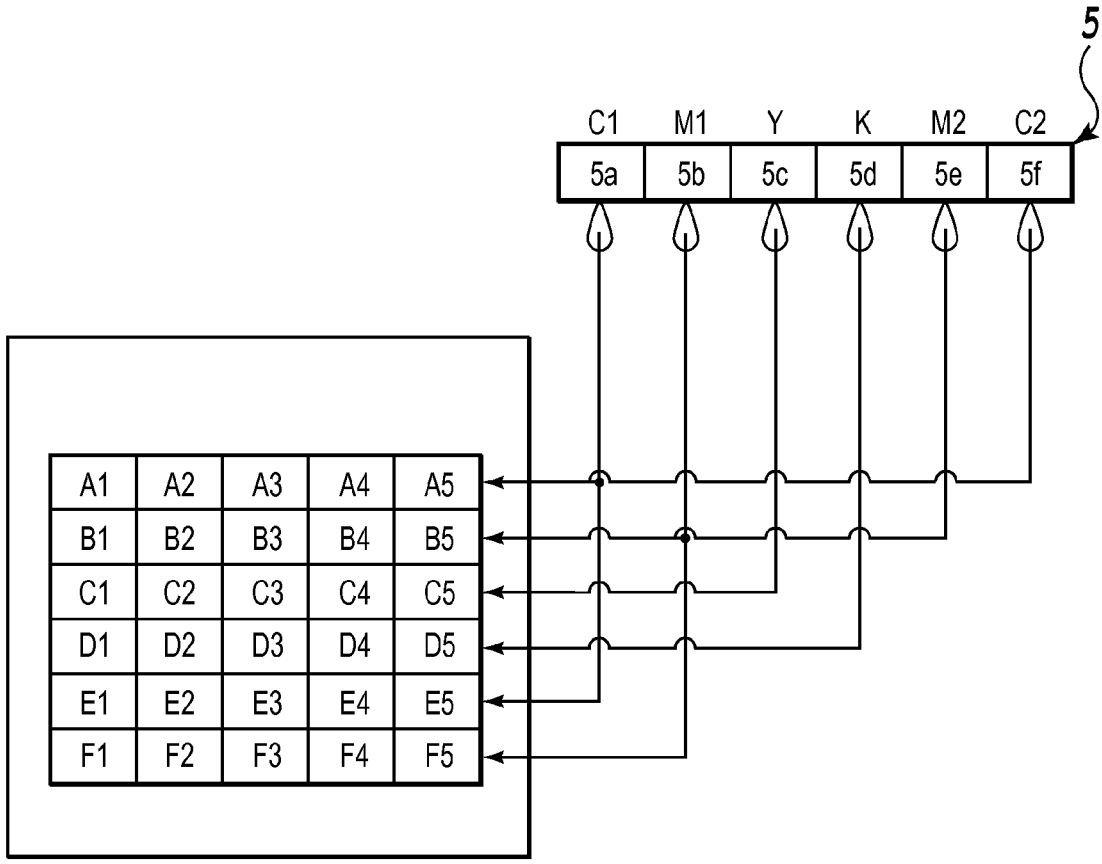
FIG. 12 is an explanatory diagram showing a correspondence between nozzle arrays and patches in the second embodiment of this invention.
Figure 13:
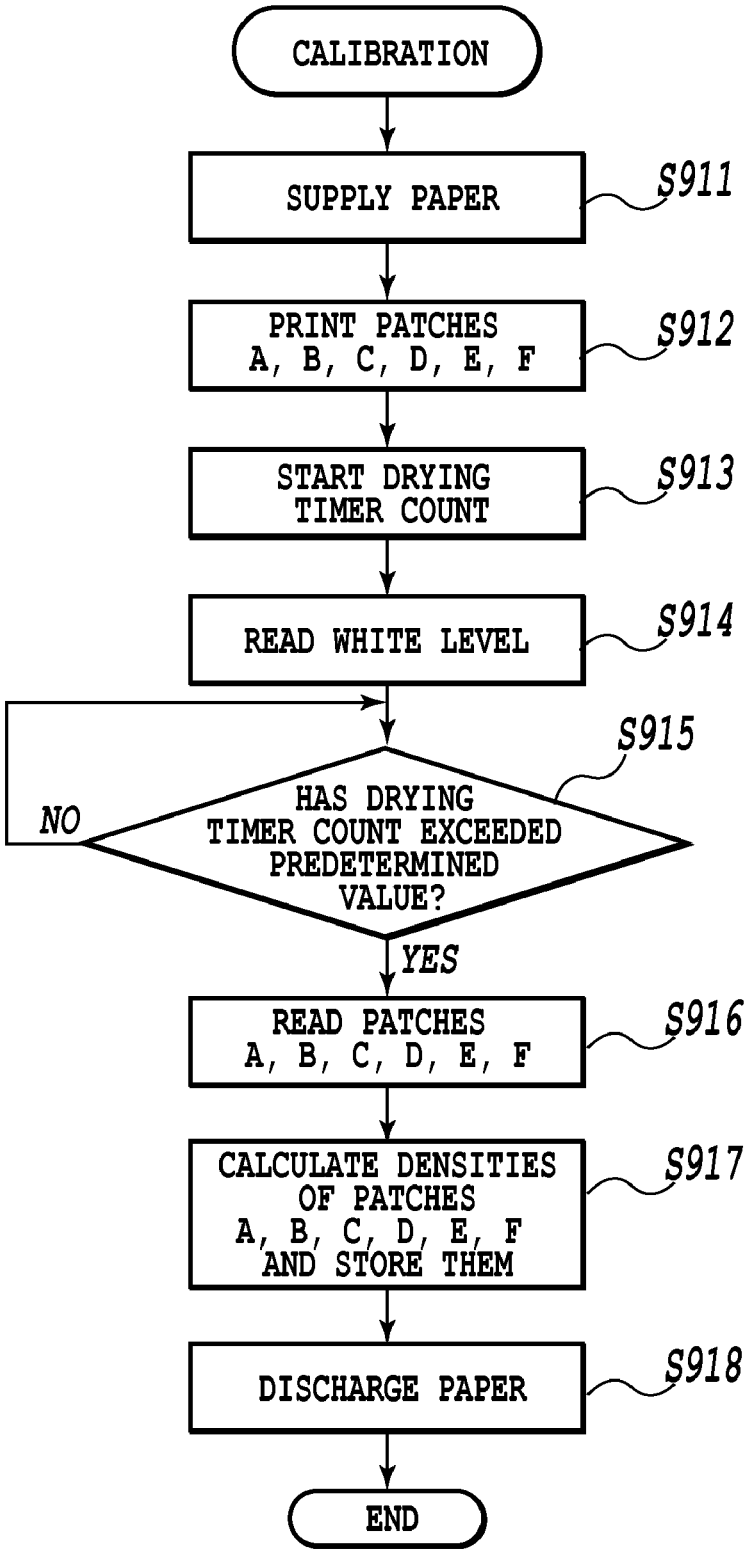
FIG. 13 is a flow chart showing a patch density measuring processing in the second embodiment of this invention.

FIG. 12 is an explanatory diagram showing a relationship between patches used in a calibration process and inks ejected from the print head 5.

The color patches A1-A5 making up the patch A are printed with C (cyan) ink ejected from C1, C2 nozzle arrays. The color patches B1-B5 making up the patch B are printed with M (magenta) ink ejected from M1, M2 nozzle arrays. The color patches C1-C5 making up the patch C are printed with Y (yellow) ink ejected from Y nozzle array. The color patches D1-D5 making up the patch D are printed with K (black) ink ejected from K nozzle array. The color patches E1-E5 making up the patch E are printed with C (cyan) ink ejected from C1 nozzle array. The color patches F1-F5 making up the patch F are printed with M (magenta) ink ejected from M1 nozzle array.

In these patches A-F, the attached numbers 1-5 indicate that there are five values (ranks) in a gradation (corresponding to print density) level. As to the patch A, for example, there are five patches A1-A5 with different densities corresponding to five gradation values. The same can also apply to other patches. Such gradation values are not limited to five values (five ranks) and the attached numbers 1-5 to the patches do not need to be related to the gradation values.

FIG. 10 is a flow chart showing an operation of the printer 200 from the start of patch printing to the measurement of density after the calibration execution demand is issued.

When an instruction to execute the calibration processing is entered from the host device or from the operation panel of the printing apparatus, a print medium is supplied (S911) for patch printing. Then, patches A, B, C, D, E, F are printed (S912). As described above, the patches A are printed by the C1 and C2 nozzle arrays; the patches B are printed by the M1 and M2 nozzle arrays; the patches C are printed by the Y nozzle array; the patches D are printed by the K nozzle array; the patches E are printed by the C1 nozzle array; and the patches F are printed by the M1 nozzle array.

Next, a drying timer is started for leaving the patches to stand for a predetermined drying time (α seconds in this embodiment) (S913).

Then, a reflection brightness of a white level (ground color of a print medium) is started to be measured using the multi-purpose sensor 102 (S914). White level measurements are used as a reference white in calculating densities of patches to be printed. So, the white level measurements are stored for each light receiving element (phototransistor) used for measurement the white level.

After the count value of the drying timer is confirmed to have exceeded a predetermined time (the predetermined time has elapsed) (S915), the measurement of reflection brightness of patches A, B, C, D, E, F is started (S916). In taking measurements of the reflection brightness, one of the LEDs 205, 206, 207 mounted in the sensor 102 that is suited to the ink color of the patch being measured is illuminated. Then, the reflected light from the patch is read by the phototransistors 203 and 204 as patch density measuring means. The LED 205 with a green light emitting wavelength is turned on, for example, when measuring the reflected light from the patches B, F printed with M ink and when measuring the reflected light from the blank portion (white) of the print medium not printed with patches.

The LED 206 with a blue light emitting wavelength is illuminated, for example, when measuring the reflected light from the patches C and D printed with Y ink and K ink and when measuring the reflected light from the blank portion (white) of the print medium not printed with patches. The LED 207 with a red light emitting wavelength is turned on, for example, when measuring the reflected light from the patches A, E printed with C ink and when measuring the reflected light from the blank portion (white) of the print medium not printed with patches.

After the reflected light from the patches A-F has been measured, densities of the patches A, B, C, D are calculated from the reflected light measurements of the patches and the reflected light measurement of the blank portion (white). The density values of the patches are stored in the memory 306 or RAM 20*b* in the printer body (S917). Then, the print medium is discharged (S918) before terminating the processing.

In the calibration, the contents of color deviation correction processing (S424, S434) are changed according to the measured densities of the patches (also referred to as "measured densities"). In this embodiment, the table (1-dimensional LUT) 404A used in the color deviation correction processing is corrected.

In this embodiment, the print mode 1 uses two nozzle arrays C1, C2 to eject C ink and two nozzle arrays M1, M2 to eject M ink. In the print mode 1, by printing patches by ejecting ink from the nozzle arrays of the same color ink, the number of patches printed in one calibration process and the number of gradation ranks of multi-valued image data coincide, as in the first embodiment. Thus, the multi-valued image data can be subjected as is to the calibration. This enables the multi-valued image data after being processed by the color deviation correction processing to be binarized and then distributed to nozzle arrays.

This process obviates the need to execute the color deviation correction processing on the binarized image data after distributing the binarized image data to the nozzle arrays. Hence, it is not necessary to perform wasteful processing, such as distributing binarized image data to nozzle arrays and returning the binarized data to multi-valued data before executing the color deviation correction processing, or binarizing the multi-valued data after the color deviation correction processing. This prevents the image processing from becoming complex, which in turn obviates the need to use a large-capacity memory for this processing, allowing the calibration to be executed at high speed.

As described above, in the first print mode, a density correction value (1-dimensional LUT 404A) is calibrated based on the measured density values of the patches printed by a plurality of nozzle arrays ejecting the same color ink, as in the first embodiment. Then, the image data is corrected by using the calibrated density correction values, and is quantized and distributed to a plurality of nozzle arrays, thus allowing an image of correct color to be printed.

Other Embodiments

A plurality of nozzle arrays ejecting the same color ink may be formed in a single print head, rather than being formed in separate print heads making up an assembly print head as in the preceding embodiments. In that case, these nozzles may be formed in one head chip or in separate chips. The plurality of nozzle arrays ejecting the same color ink are not limited to the nozzles ejecting C (cyan) and M (magenta) ink. The only requirement is that an image can be printed by using a plurality of nozzle arrays ejecting the same color ink.

As described above, preparing or selecting an LUT to be used after a γ correction processing according to density information read from printed patches allows for execution of the color deviation correction processing. The color deviation correction processing can also be performed by changing the LUT used in the γ correction processing according to the density information read from the printed patches.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-205910, filed Aug. 7, 2007, which is hereby incorporated by reference herein in its entirety.

What is claimed is:

1. A printing apparatus for printing an image by using a print head having a plurality of nozzle arrays in each of which a plurality of nozzles capable of ejecting ink of the same color are arranged in line, the printing being performed by ejecting ink from the plurality of nozzles according to print data corrected by a correction processing, the printing apparatus comprising:

a patch printing unit that prints a patch; and a calibration unit that changes a content of the correction processing according to printed results of the patch, wherein the patch printing unit prints the patch by ejecting ink from the plurality of nozzles arranged in the plurality of nozzle arrays capable of ejecting ink of the same color, and wherein the calibration unit changes, according to the printed result of the patch, the content of the correction processing used to correct the print data for ejecting ink of the same color.

2. A printing apparatus according to claim 1, wherein the calibration unit includes a measuring unit to measure densities of the patch.

3. A printing apparatus for printing an image by using a print head having a plurality of nozzle arrays in each of which a plurality of nozzles capable of ejecting ink of the same color are arranged in line, the printing being performed by ejecting ink from the plurality of nozzles according to print data corrected by a correction processing, the printing apparatus comprising:

a patch printing unit that prints a patch; and a calibration unit that changes a content of the correction processing according to printed results of the patch, wherein, when a print mode that uses the plurality of nozzle arrays capable of ejecting ink of the same color is selected from among a plurality of print modes, the patch printing unit prints the patch by ejecting ink from the plurality of nozzles arranged in the plurality of nozzle arrays capable of ejecting ink of the same color, and wherein the calibration unit changes, according to the printed result of the patch, the content of the correction processing used to correct the print data for ejecting ink of the same color.

4. A calibration method in a printing apparatus, the printing apparatus printing an image by using a print head having a plurality of nozzle arrays in each of which a plurality of nozzles capable of ejecting ink of the same color are arranged in line, the printing being performed by ejecting ink from the plurality of nozzles according to print data corrected by a correction processing, the calibration method changing a content of the correction processing, the calibration method including:

a patch printing step to print a patch; and a calibration step to change a content of the correction processing according to printed results of the patch, wherein the patch printing step prints the patch by ejecting ink from the plurality of nozzles arranged on the plurality of nozzle arrays capable of ejecting ink of the same color, and wherein the calibration step changes, according to the printed result of the patch, the content of the correction processing used to correct the print data for ejecting ink of the same color.

5. A calibration method according to claim 4, wherein the calibration step includes a step to measure densities of the patch.

6. A calibration method in a printing apparatus, the printing apparatus printing an image by using a print head having a plurality of nozzle arrays in each of which a plurality of nozzles capable of ejecting ink of the same color are arranged in line, the printing being performed by ejecting ink from the plurality of nozzles according to print data corrected by a correction processing, wherein an image print mode can be selected from among a plurality of print modes, the calibration method changing a content of the correction processing, the calibration method including:

a patch printing step to print a patch; and a calibration step to change a content of the correction processing according to printed results of the patch, wherein, when a print mode that uses the plurality of nozzle arrays capable of ejecting ink of the same color is selected from among a plurality of print modes, the patch printing step prints the patch by ejecting ink from the plurality of nozzles arranged in the plurality of nozzle arrays capable of ejecting ink of the same color, and wherein the calibration step changes, according to the printed result of the patch, the content of the correction processing used to correct the print data for ejecting ink of the same color.

7. A printing apparatus to perform printing according to binary data corresponding to each of a plurality of nozzle arrays, the plurality of nozzle arrays being adapted to eject a predetermined color ink, the printing apparatus comprising:

a control unit that causes a pattern corresponding to a plurality of gradation values of the predetermined color to be printed with ink of the predetermined color ejected from the plurality of nozzle arrays;

a measuring unit that measures information about a density of the pattern printed by the control unit;

a correction unit that corrects multi-valued data according to the information measured by the measuring unit, the multi-valued data defining printing of the predetermined color;

a conversion unit that transforms the multi-valued data corrected by the correction unit into the binary data; and a distribution unit that distributes the binary data converted by the conversion unit to the plurality of nozzle arrays.

8. A printing apparatus according to claim 7, wherein the plurality of the nozzle arrays are formed in a single chip in a print head.

* * * * *